US006925422B1

(12) United States Patent
Desmond

(10) Patent No.: US 6,925,422 B1
(45) Date of Patent: Aug. 2, 2005

(54) SYSTEM AND METHOD FOR MONITORING THE PERFORMANCE OF AN INDOOR AIR ENVIRONMENT PRODUCT INSTALLATION

(75) Inventor: John S. Desmond, Concord, MA (US)

(73) Assignee: AirQual, Canton, MA (US)

( * ) Notice: Subject to any disclaimer, the term of this patent is extended or adjusted under 35 U.S.C. 154(b) by 0 days.

(21) Appl. No.: 10/190,302

(22) Filed: Jul. 5, 2002

Related U.S. Application Data

(60) Provisional application No. 60/303,234, filed on Jul. 5, 2001.

(51) Int. Cl.[7] ..... G04F 10/00

(52) U.S. Cl. ..... 702/187; 702/183; 702/184

(58) Field of Search ..... 702/1, 188, 108, 702/122, 105, 183, 184, 187; 710/303, 305; 250/345; 340/870.02, 870.17; 700/276; 73/31.01, 31.05

(56) References Cited

U.S. PATENT DOCUMENTS 5,529,807 A * 6/1996 Burkhart et al. ..... 427/372.2
2002/0144537 A1 * 10/2002 Sharp et al. ..... 73/31.01

* cited by examiner

*Primary Examiner*—John Barlow
*Assistant Examiner*—Stephen J. Cherry
(74) *Attorney, Agent, or Firm*—Mills & Onello LLP

(57) ABSTRACT

A system and method provide the ability to establish, record, track, and report on all phases of product utilization and performance from the design phase to end use performance and validation in a real time environment. The present invention enables an organization, referred to herein as a participant or user, to measure, understand and promote tangible results as to the performance of an indoor air environment product installation. In one example, product performance gains can be monitored and reported.

40 Claims, 7 Drawing Sheets

SYSTEM AND METHOD FOR MONITORING THE PERFORMANCE OF AN INDOOR AIR ENVIRONMENT PRODUCT INSTALLATION

RELATED APPLICATIONS

This application claims the benefit of the filing date of U.S. Provisional Application Ser. No. 60/303,234, filed Jul. 5, 2001, the contents of which are incorporated herein by reference in their entirety.

BACKGROUND OF THE INVENTION

With the rapidly increasing frequency of the incidence of mold-related illnesses and respiratory diseases, consumers have a genuine concern for healthy indoor air environments. Currently, there is no source to evaluate the thousands of indoor air environment product offerings, reputable sources of product, trained professional technicians, or proven efficacy to substantiate the many product performance claims made by suppliers and manufacturers. Further there is no resource for government, insurers, industrial hygienists, and other professionals associated with the construction industry to have a readily accessible, credible, and independent source for this critical information.

Poor indoor air quality and the related phenomenon referred to as "sick building syndrome" (SBS) result in reduced workforce productivity, poor morale and increased health care costs. The management of indoor environments is critical to improving poor indoor air quality. Reduction of microbe levels through the use of "clean" and efficient building systems, as well as protection of surfaces against the unwanted growth and spread of mold have proven effective in improving overall air quality. Such efforts have been shown to reduce health hazards and their associated costs, and to improve air moving system efficiency.

The events of September $11^{th}$ and subsequent bioterrorist activities at postal, government and other facilities have placed greater public emphasis on indoor environmental quality issues. As a result, there exists a significant need for Environmental Protection Agency (EPA)-registered applications for immediate and preventive treatments. As a matter of public safety, the EPA has jurisdiction over the sale and use of such products.

Currently, there are over 8,000 EPA-registered antimicrobial products commercially available. They range in usage from residential to industrial and may contain hazardous materials. In some instances they are classified as carcinogens. To date, there has been no effective, centralized effort to classify and record the efficacy of the products or to document the specific economic and health effects of their use. There is no central repository of the date, type, and method of deployment of the products or the entities involved with the specification, distribution, application, and maintenance of the products.

SUMMARY OF THE INVENTION

The present invention provides the ability to establish, record, track, and report on all phases of product utilization and performance from the design phase to end use performance and validation in a real time environment. A system and method are provided for enabling an organization, referred to herein as a participant or user, to measure, understand and promote tangible results as to the performance of an indoor air environment product installation. In one example, antimicrobial and energy efficient product performance gains can be monitored and reported.

The system and method are, in one example, implemented in part by software that operates on a central Web site. Through this Web site, the participant provides practical validation of new air environment technologies and ideas and best practices, or better ways, of working, thereby minimizing inherent variance in project decision making. A participant can enroll, for example via an automated registration process, as a project team member, and access, distribute, or deliver information through an interactive environment, collaborate through messaging, workflow and discussion, publish information to a broader audience, including individuals outside a given project, and further manage the project.

Product installation site data can be gathered, organized and profiled over the full life cycle of the product in a common repository or database. A participant accesses the information, for example, via a distributed collection of interlinked, user-viewable hypertext documents (commonly referred to as Web documents or Web pages) that are accessible via the Internet, and via client-server software components that provide user access to such documents using standardized Internet protocols.

As part of the online registration, the application is processed, for example, either automatically or by a staff member of the party managing the central database, and the enrollment system generates and assigns a unique participant identification to the applicant and stores this identification, together with other participant information, in a participant database. In addition to recording the project information, for example, project name, building and type of product used, additional information can be entered for a project in a number of monitoring subject topics, for example, compliance, performance measurement, and feedback. As an example, for each topic, the following information can be entered: date, comments, file attachments, author, and the like.

The important benefit of recording the deployment and maintenance events provides the participant with greater economies in administration costs (for example, fulfillment), project costs (for example, production, distribution and maintenance), improved responsiveness (for example on-demand and in real-time) and current (real-time) information with regard to customer needs. The project software may optionally include text-scanning code that automatically scans the completed forms for pre-specified words and phrases that may give rise to profit patterns for sellers and suppliers.

As the project enrollment, tracking and referral functions are automated in whole or in part, the participant can realize enhanced productivity in product selection and installation, with minimal supervision.

In one aspect, the method of the present invention is directed to a method for monitoring data related to the performance of an indoor air environment product installation. Installation site data related to an indoor air environment at a product installation site is collected. The installation site data is stored. From the stored installation site data, performance data derived from the installation site data is retrieved and the performance data is provided to an authorized user of the data.

In one embodiment, the collection of installation site data is performed periodically. In another embodiment, the collection is performed manually or automatically.

In another embodiment, the collection of installation site data comprises collecting pre-installation data or post-installation data. Pre-installation data comprises for example, installer data, contractor data, building data, and product data. Post-installation data comprises, for example, data related to the indoor air environment selected from the types of data consisting of: building owner data; building manager data; building system performance data; coupon data; medical data of occupants; and insurance data.

In one embodiment, the product comprises an antimicrobial coating applied to a substrate. In other embodiments, the product may comprise any of a number of products related to indoor air environments, including air moving equipment, air filters, air purifiers, and the like.

The installation site data may be stored in a central or distributed computer database, in which case the step of retrieving comprises retrieving the installation site data from the computer database. The installation site data may be remotely stored using a Web-based user interface.

The step of retrieving may further comprise analyzing the performance data. The performance data itself may be related to the performance of the product installation. The product installation site may be, for example, residential or commercial. The user may, for example, comprise a customer of the performance data.

The step of collecting installation site data may comprise collecting multiple installation site data related to instances of multiple indoor air environments at multiple product installation sites. In addition, the step of retrieving may comprise retrieving performance data derived from the installation site data of multiple product installation sites.

The performance data may, for example, be related to the effectiveness of the product at the installation site. The performance data may be distributed to authorized users via the Internet, or may be generated in the form of an electronic report and distributed via email or via web-based interface.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

The present invention is directed to a method for monitoring data related to the performance of an indoor air environment product installation, for example an antimicrobial treatment applied to an HVAC system for an existing or new building. Installation site data related to an indoor air environment at a product installation site is collected, for example automatically by meter, with the data being electronically transferred to a host database, or alternatively, manually, by an on-site worker or laboratory scientist that reviews and reports the data to the central data repository. The installation site data is stored, for example at the host server for the central data repository. From the stored installation site data, performance data derived from the installation site data is retrieved by the host service company and the performance data is provided to an authorized user of the data, for example by electronic or printed reporting.

In this manner, a centralized service is provided that enables players in the indoor air environment industry to research products and services, including, for example, new antimicrobial surface treatment products. In addition, the players can share ideas and solutions related to indoor air environment quality and energy efficiency. The centralized service also provides a forum at which players and end-users keep informed on Sick Building Syndrome and other risks, and keep advised of the latest research and legislation to ensure that the highest indoor air environment standards are achieved.

The data that is recorded, compiled and reported can be based, for example on both pre-installation and post-installation activities, that is, activities related to the selection and installation of an indoor air environment product (pre-installation) and related to the performance of the product (post-installation). Pre-installation data may comprise, for example, data related to the installer of the product, data related to the structure, size, etc. of the building in which the product is installed, data related to the general contractor, data related to the type of product chosen, manufacturer of the product, and the like. Post-installation data may comprise, for example, metric data collected from electronic meters, coupons, and the like related to the indoor air environment, maintenance data, data related to the owner and occupant of the building, medical data for the occupants, insurance data for the building and occupants, and the like. In this manner a complete database is compiled, related to the product selection and installation process and to product performance, which can be made available to customers of the system for use in future consideration and evaluation of indoor air environment products.

1. Overview of System Components and Operation

Figure 1:
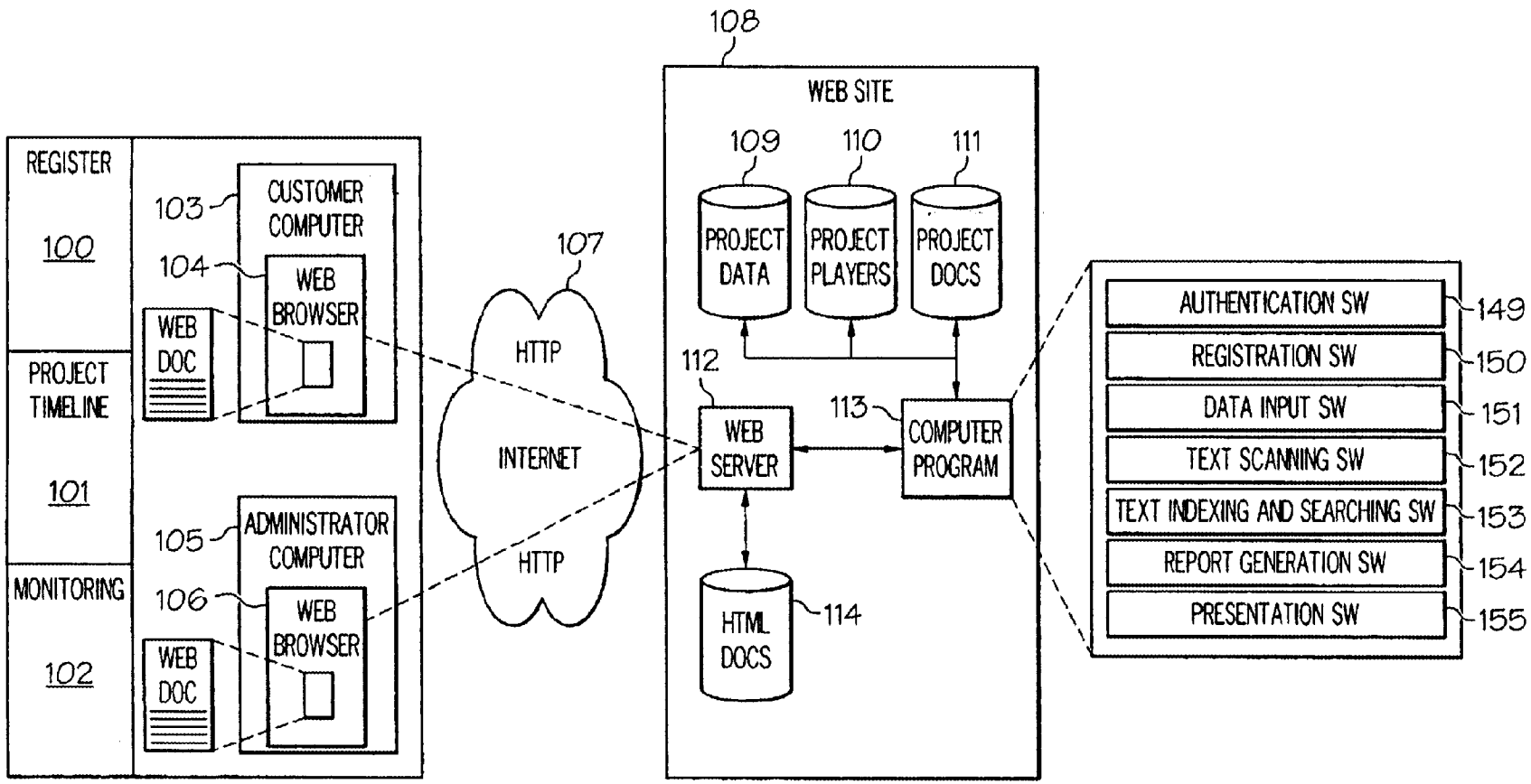
FIG. 1 is a conceptual block diagram illustrating the primary components of a system that operates in accordance with the present invention.

FIG. 1 illustrates the general architecture of a project registration system that operates in accordance with the present invention. The system includes a customer computer 103, an administrator computer 105, and a project monitoring Web site 108, all of which are linked together by the Internet 107. The customer 103 and administrator 105 computers may be any type of computing device that allows a user (for example a customer or administrator) to interactively browse Web sites via a Web browser 104, 106. For example, the customer or administrator computers 103, 105 may comprise personal computers (PC) that run the Windows XP operating system.

The project monitoring Web site 108 is a site that provides various functionality for allowing customers to register projects, add details of project activity and view reports of this activity. This site may, for example, be operated by a host business entity (referred to herein as the "merchant") that owns a license for the indoor air environment products deployed in the projects being monitored. In an implementation described herein, the merchant Web site 108 comprises the site of the Web-page functionality described.

As described below, the site 108 includes registration software 150 that implements an online registration process 100 involving indoor air environment-related projects carried out by other entities 103 (individuals, companies, etc.) as well as an administrator 105. An entity enrolling a project provides the merchant Web site 108 with a completed, online registration application that is processed by a registration software program ("SW") 150 at the Web site 108. The registration software creates an entry in the project data database 109 for the project and as many entries in the project players database 110 as is necessary according to the information provided by the registering entity.

At any time, the registering entity can maintain and update the information held in the project data database 109 and the project players database 110.

Once the project has been registered, the registering entity or any of the other authorized project players can gain access to the information held in the project data database 109 and the project players database 110.

Once the project is underway, the registering entity or any of the other authorized project players can add comments, for example related to the various activities of project deployment and maintenance. These comments are added by the registering entity or any of the other project players completing an online form on their associated Web browser 104. The information in this form is processed by the Data Input SW 151 to add it to the project data database 109. It is also processed by the Text Scanning SW 152 to analyze keywords in the text, which is used to detect recurring patterns of activity and results.

The registering entity or any of the other project players can also add comments and documents on various activities in project management monitoring. These comments and documents are added by the registering entity or any of the other authorized project players completing an online form in their Web browser 104. The information in this form is processed by the Data Input SW to add it to the project data database 109. It is also processed by the Text Scanning SW to analyze keywords in the text, which is used to detect recurring patterns of activity and results. The documents are processed by the Text Indexing and Searching SW 153 to add them to the project docs database 111 and to prepare them for later searching.

At any time, the registering entity or any of the other authorized project players can view online reports of project activity and monitoring comments and documents.

The registering entity or any of the other project players preferably can only view and maintain information in projects of which they are a player. Any customer preferably logs into the Web site 108 to gain access, and access is controlled by the Authentication SW 149.

The administrator may, on the other hand, have full rights to view and maintain any project information.

For any project registered by a customer, the original registering entity is tagged as the Project Registration Manager. For any project registered by an administrator, any project player may be tagged as the Project Registration Manager by the administrator. It is preferred that only one Project Registration Manager be assigned per project.

For any project registered, the original registering entity can nominate any project player as the Project Specifier, for the purposes of compensating that person. An administrator can later indicate when the Project Specifier payment was made. An administrator or the Project Registration Manager can change the Project Specifier nomination at any time up until the payment is made. This feature allows greater user interaction with a given project, taking some of the administrative burden off of the Web site host company, and further promoting utilization of the Web site and related products. The Project Specifier data is recorded, tracked, and monitored, to ensure that the performance of the Specifier is at a suitable level. It is preferred that only one Project Specifier is appointed per project.

In operation, the customer or administrator accesses the merchant Web site 108 using a standard Web browser 104 or 106, such as Microsoft Internet Explorer™ or Netscape Navigators™, which uses the Hypertext Transport Protocol (HTTP) to communicate with a Web server 112 of the merchant's site 108. The Web server 112 accesses a local store of form documents 114 (in the form of Hypertext Markup Language (HTML) or "Web" document) which can be requested, retrieved and viewed via the Web browser 104 or 106. These form documents 114 enable the customer or administrator to add and maintain the information in the project data database 109 and the project players database 10, and the documents in the project documents database 111.

2. Project Registration Function

Figure 2:
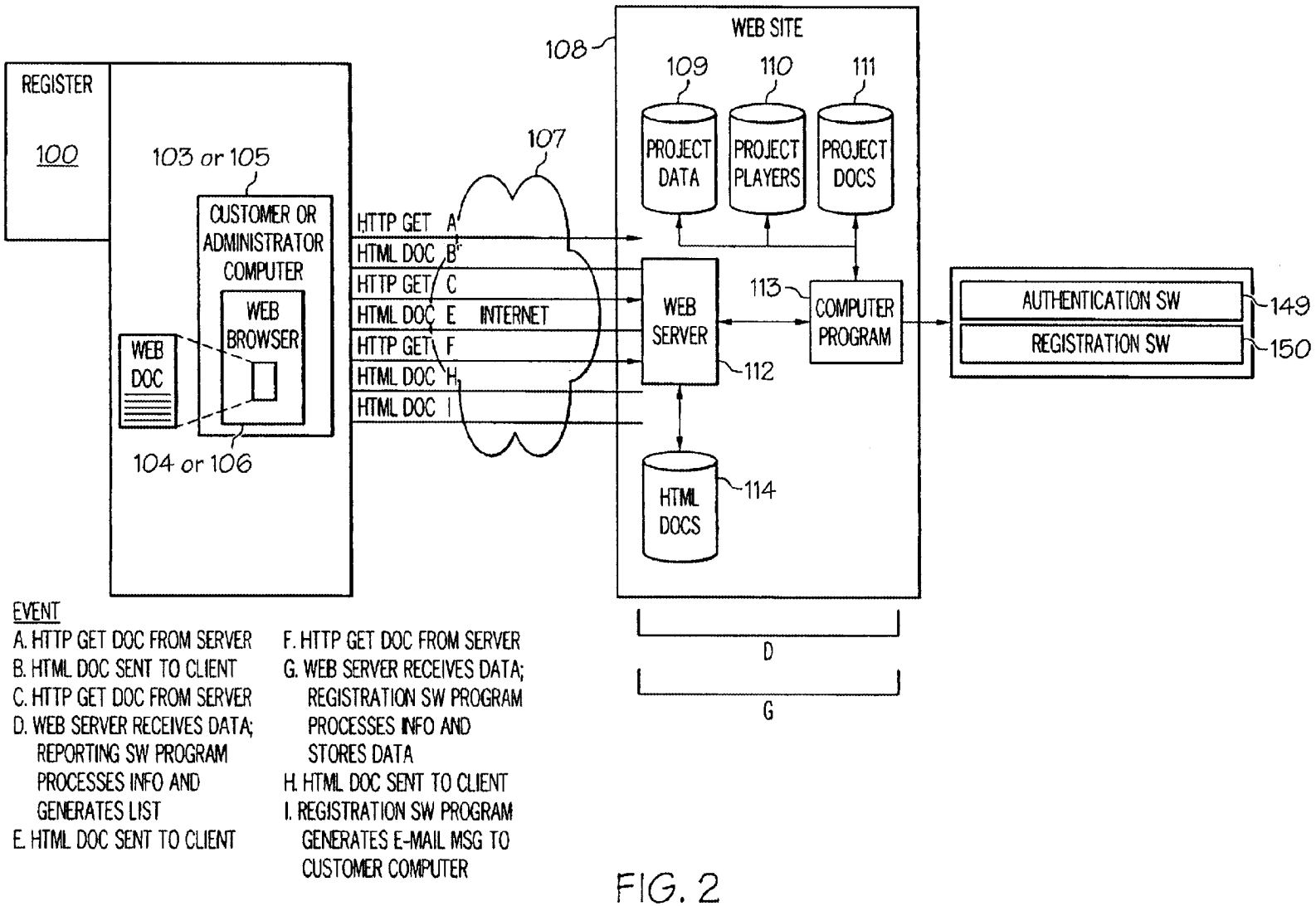
FIG. 2 is a data flow diagram illustrating the project registration function of the system.
Figure 6:
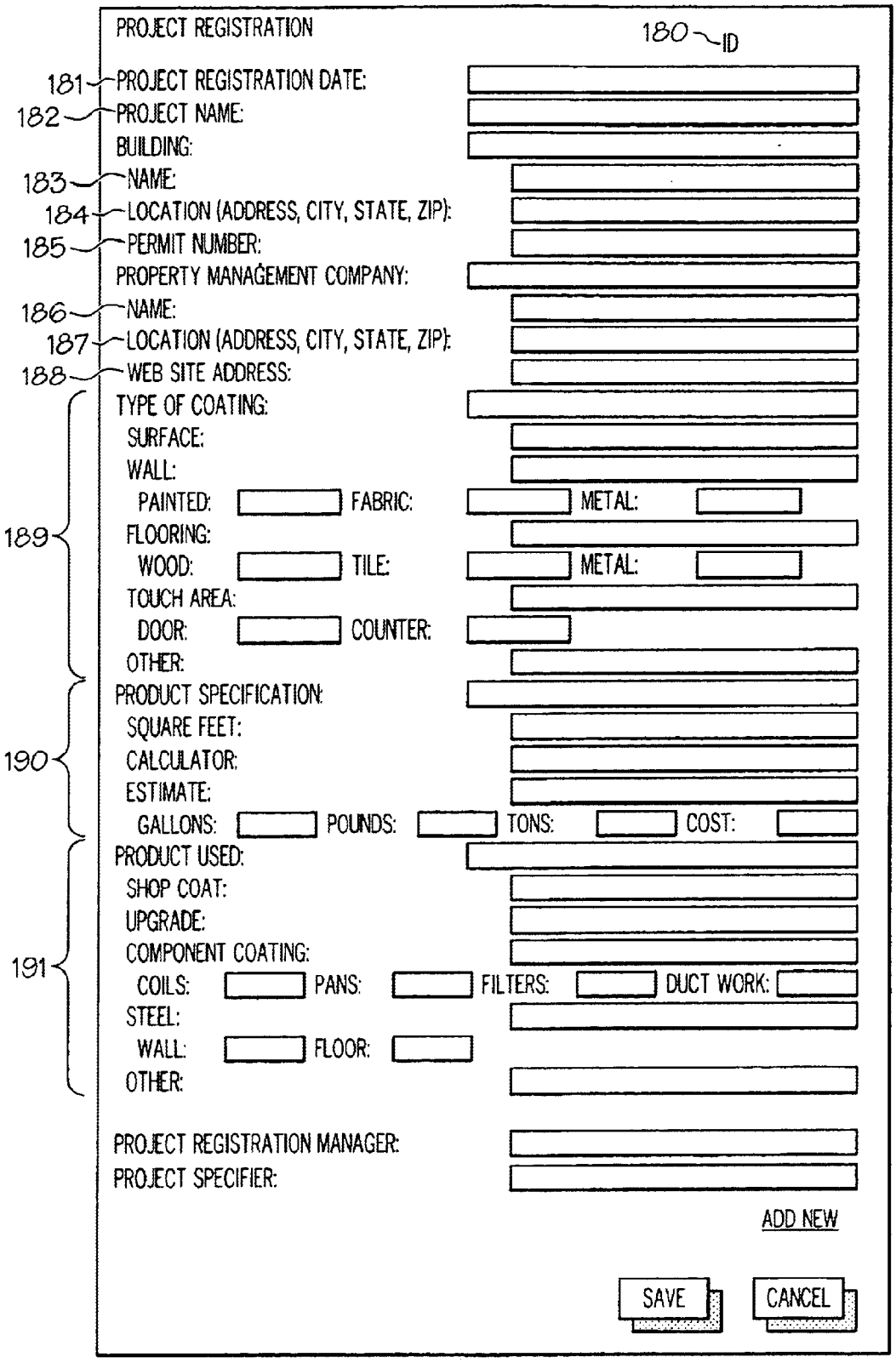
FIG. 6 is a screen display illustrating a project registration document of the Web site.
Figure 7:
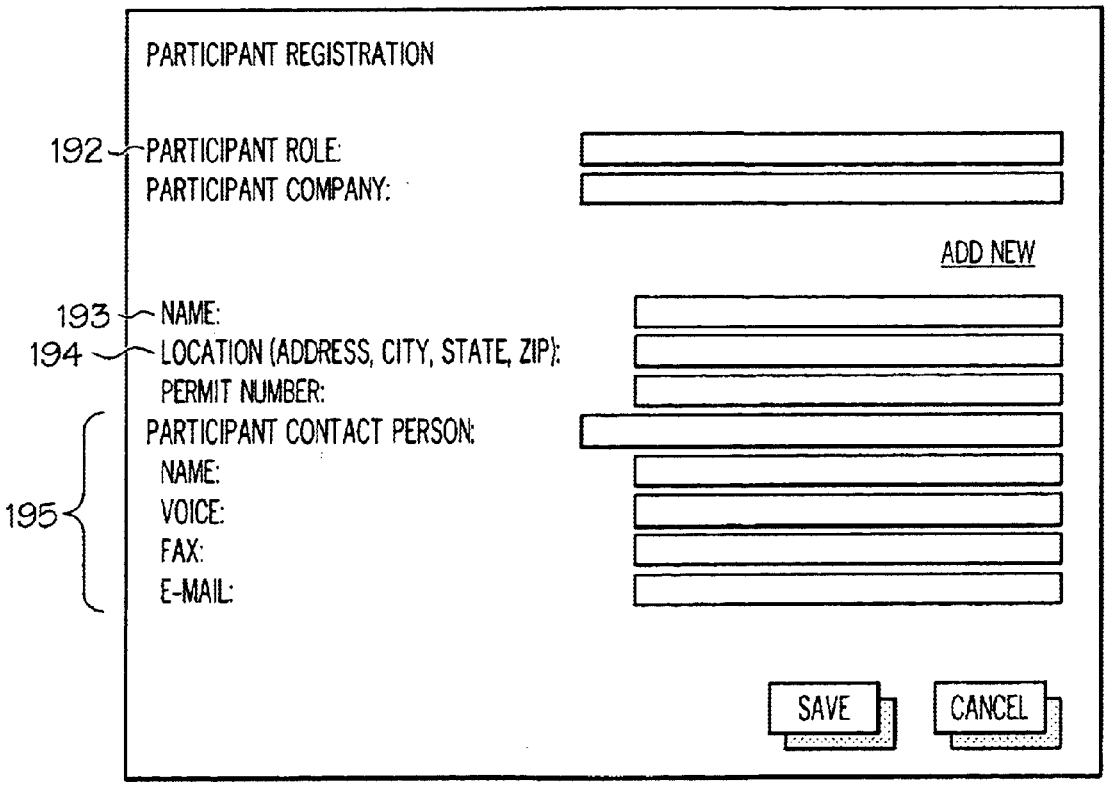
FIG. 7 is a screen display illustrating a project participant registration document of the Web site.

FIG. 2 illustrates the activities involved in a project registration. A project is registered by a registering entity (individuals, companies, etc., or an administrator). An entity enrolling a project provides the merchant Web site 108 with a completed, online registration application that is processed by a registration software program 150 ("SW") at the site 108. The registration form, shown in detail in FIG. 6, captures the following data: Project Unique Identifier 180; Project Registration Date 181; Project Name 182; Building Name 183; Location 184(Address, City, State, ZIP); Permit Number 185; Property Management Company Name 186; Location 187 (Address, City, State, ZIP); Web Site Address 188; Type of Application 189; Product Specification 190; Product Used 191. Returning to FIG. 2, the registration software 150 creates an entry in the project data database 109 for the project. Additionally, the registering entity adds as many project players to the form as possible, capturing the following data, with reference to FIG. 7: Role 192 (for example, the types of players may include Building Owner, Permittee Contact Person, Property Management Company Contact Person, Architect, Engineer, Structure Manager, Mechanical Contractor, Mechanical Consulting Engineer, Sheet Metal Contractor, Service Center Contact Person, Regional Distributor); Player Company Name 193; Location 194 (Address, City, State, ZIP); Web Site Address; Player Contact information 195, including Person, Name, Voice, Fax, and E-mail address. Returning to FIG. 2, the registration software 150 creates as many entries in the project players database 110 as needed, according to the information provided by the registering entity.

For any project registered by a customer, the original registering entity is tagged as the Project Registration Manager. For any project registered by an administrator, any project player may be tagged as the Project Registration Manager by the administrator. It is preferred that only one Project Registration Manager is assigned per project.

For any project registered, the original registering entity can nominate any project player as the Project Specifier, for the purpose of compensating that person. An administrator can later indicate when the Project Specifier payment was made. An administrator or the Project Registration Manager can change the Project Specifier nomination at any time up until the payment is made to compensate those individuals that promote the use of the system and related products. Pertinent information is captured that may be useful for third parties, who may decide to use the specifiers as designators of the third party product or service. The system provides for details related to the specifiers, and for successful project outcomes.

3. Project Timeline Recording Function

Figure 3:
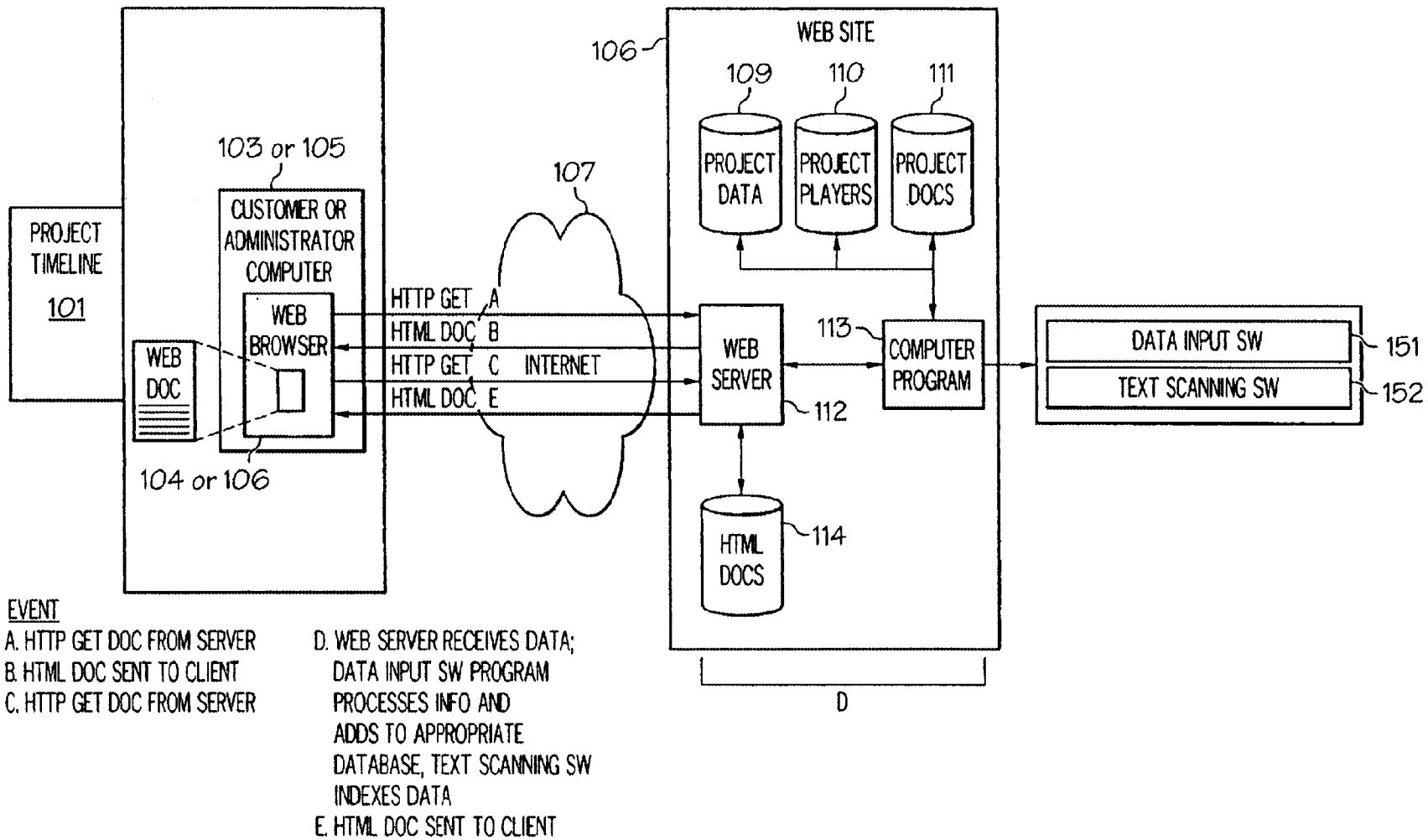
FIG. 3 is a data flow diagram illustrating the project timeline recording function of the system.

FIG. 3 illustrates the activities that take place in tracking a project timeline. The project players or the administrator can track the activities that take place over the timeline of the project. The timeline, which involves the various activities for a project as well as various benchmarks for those, is divided into two phases: Deployment and Maintenance. Deployment includes, for example, the following activities: Origination; Registration; Verification; Order; Ship; Delivery; Fabrication; Installation; Acceptance; Maintenance. Maintenance may include, for example, the following activities: inspection, reporting, follow-up service and upgrades.

For each activity, a project player or an administrator can add the information: Date; Comments; Author. The timeline and Date, Comments and Author fields can be viewed, for example, by every project player or the administrator named for that Project. It is preferred that only the Comment Author or Administrator is authorized to add, edit or delete a Comment.

A critical feature of the system is the ability to record, analyze and service installations of air environment products. This permanent record allows subsequent participants to have access to historical information and thereby using this knowledge to make product installation decisions regarding, for example, ongoing maintenance, product upgrades, and product services. The benefit flows to both the end user as well as to the product and service providers. This provides a valuable base of product performance and efficacy that may result in product refinements and improvements over time. It also provides a lasting archive of information relative to "state of the art" product application and availability that may be used to substantiate potential future litigation for either plaintiff or defendant. Since technology and methods are not static, but continuously evolve, a trusted log of all activity related to an indoor air environment, may well soon become a mandatory requirement placed on building managers or owners. This maintenance record also provides a valuable cost/benefit tool for all parties in assessing future needs and effective treatments.

4. Project Monitoring Function

Figure 4:
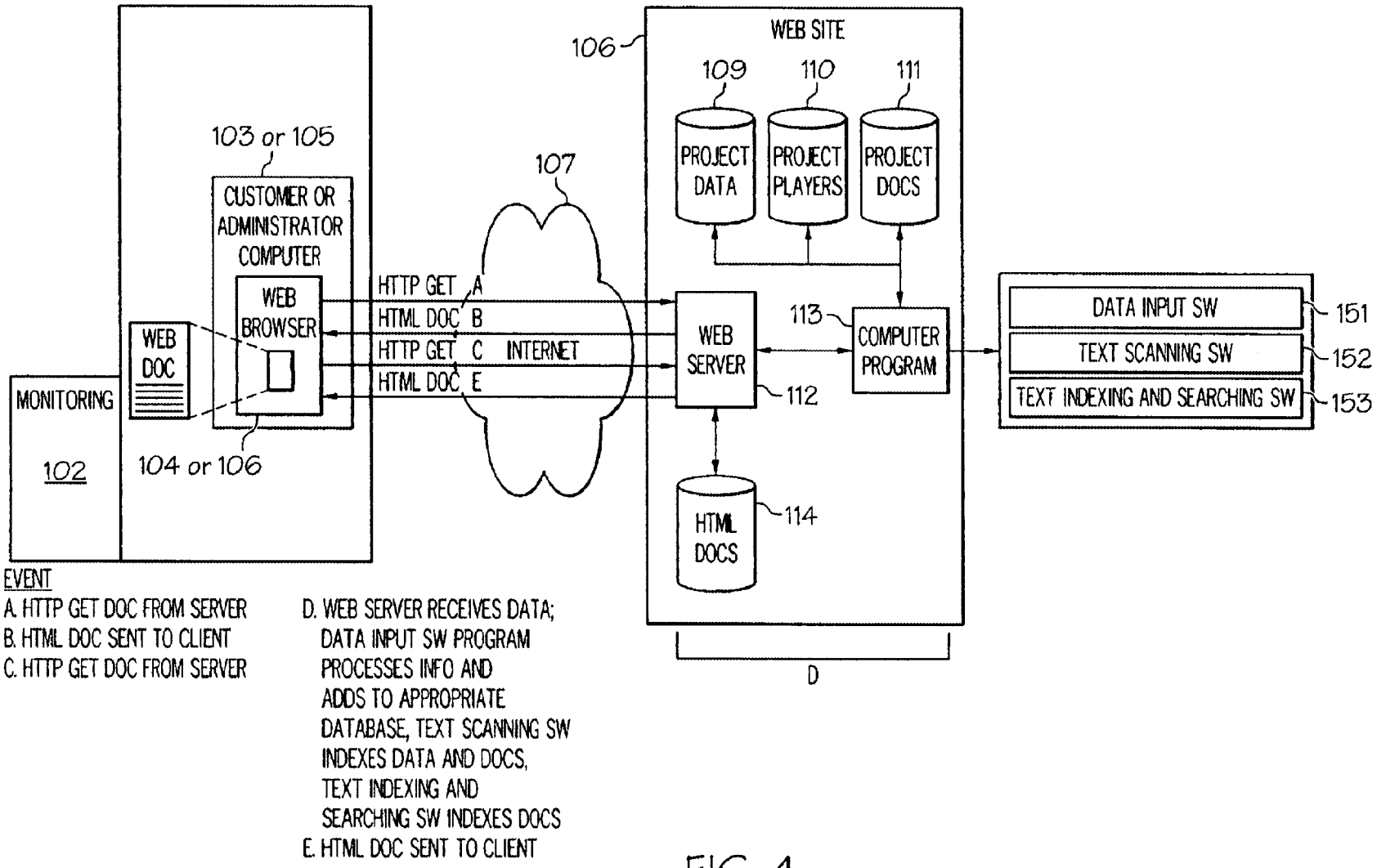
FIG. 4 is a data flow diagram illustrating the project monitoring function of the system.

FIG. 4 illustrates the activities that take place in monitoring a project. The project players or the administrator can enter additional information related to Deployment or Maintenance monitoring. Deployment includes the following areas: Training; Documentation; Compliance; System Management. Maintenance includes the following areas: Site Performance Measurement; Feedback; Evaluating Results; Revising or Improving Test Environment; Reporting.

For each monitoring area, the following information is entered: Date; Comments, File attachments; Author.

The monitoring subject area and Date, Comments, File attachments and Author fields can be viewed by every project player or the administrator. Preferably, only the Comment Author or administrator can add, edit or delete a Comment or File attachment.

5. Project Reporting Function

Figure 5:
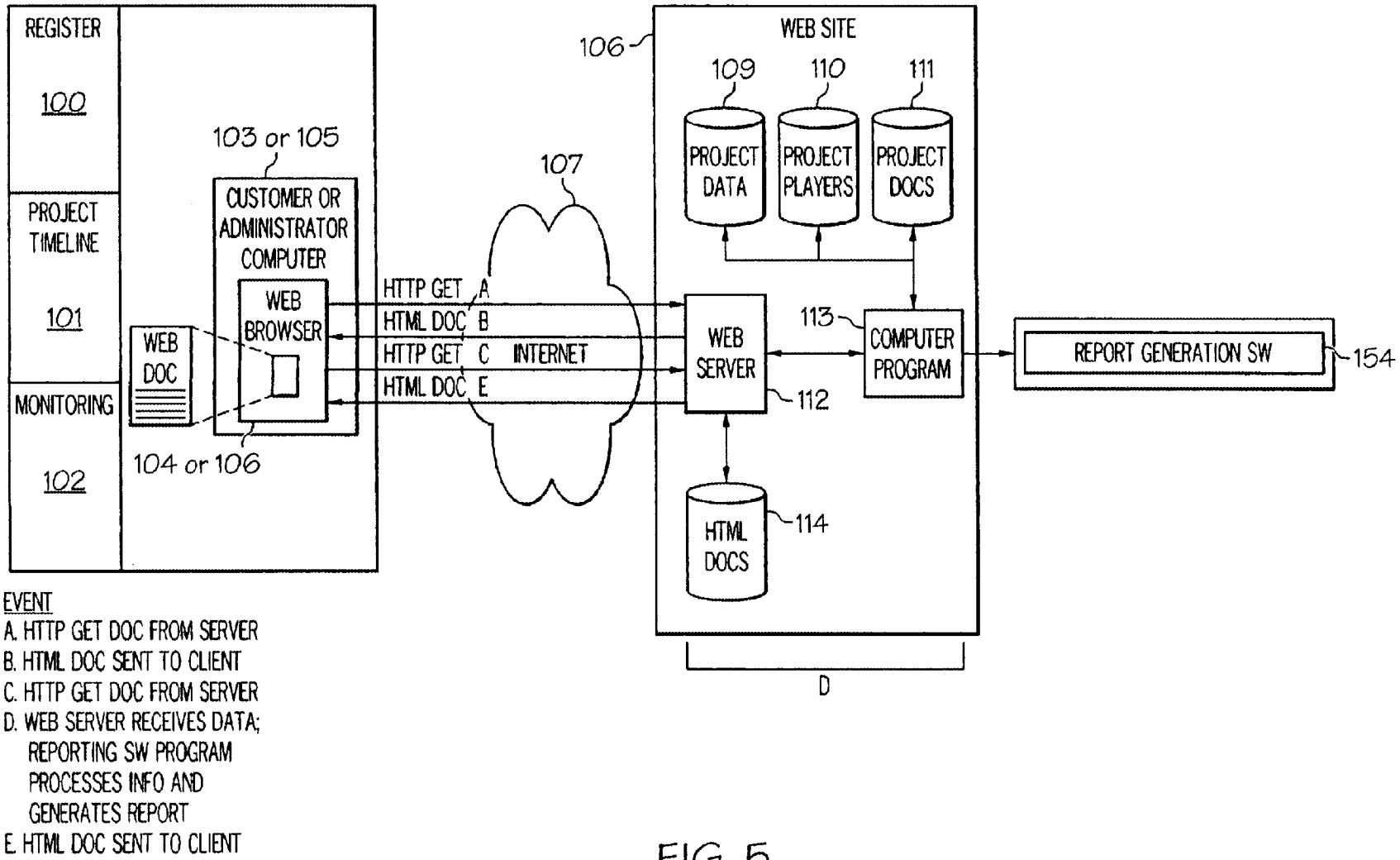
FIG. 5 is a data flow diagram illustrating the project reporting function of the system.

FIG. 5 illustrates the activities that take place in viewing project reports. A project player or an administrator can view reports on the project activities and monitoring.

Possible reports include: Projects; Projects Maintenance, Building Location; Property Management Company Name; Type of Application; Product Specification; Product Used; Player Company Name in Player Role; Project Registration Manager Name; Project Specifier Name; Timeline.

As every project is unique, the ability to use real time data associated with each project is a valuable tool for all participants in a given project. The present invention thus provides a true project overview system that encompasses the needs of all participants, is not limited to information related to a single participant and a single installation, and extends beyond the life of a project or entity involved.

A new industry has developed in recent years involving insurance archivists, arising from the need to provide relevant insurance policy and property management practices related to environmental claims made by governments and third parties. The ability to be removed from litigation or to produce evidence of valuable insurance coverage many years after a given incident has helped countless corporate entities. The system and method of the present invention provides the basis for such evidence and the ability to produce necessary historical information regarding not only the installation, but also the maintenance and upgrade of such properties. The financial services sector may also have a need for this information in the future. The ability to transfer property may be facilitated by having rapid access to such data. Banks may alter terms or outright deny access to funds without such information.

Contractors and other service personnel continually strive for methods to provide additional valuable services to their client base. The after-sale activities often determines whether there will be repeatable sales opportunities for any particular client. The use of antimicrobial and other energy efficient products is an ongoing process. They are not like fixed systems and are complex. The prime reason for using these products is to prevent something from occurring. The ability to measure and assess efficacy is by nature comparative to other data either specific to past history or relational to similar non-treated properties.

By their very nature all such indoor air environment products are exhaustible. Any blanket assumption that they are functional may in fact cause more harm than good. It therefore becomes prudent for all involved to maintain and monitor performance for efficacy and reliability. This can be done either remotely, through building telemetry, or by physically providing on-site inspection and maintenance. This, in conjunction with correlation with appropriate performance data, will lead to an informed decision as to current and future product and service needs as well as product innovation. The importance in handling dynamic, and not static, conditions places considerable burden on the need for an ongoing monitoring maintenance and subsequent recording system that allows for the assessment and achievement of desired results.

While this invention has been particularly shown and described with references to preferred embodiments thereof, it will be understood by those skilled in the art that various changes in form and details may be made herein without departing from the spirit and scope of the invention as defined by the appended claims.

I claim:

1. A method for processing data related to the performance of an indoor air environment product installation comprising:

collecting installation site data related to indoor air environments at multiple product installation sites, wherein the installation site data of a product installation site comprises pre-installation data related to the characteristics of an installed product and information corresponding to the product installation site, and post-installation data related to an effect that the installed product has on the indoor air environment at that site;

storing the installation site data, including the pre-installation and post-installation data of the multiple product installation sites, at a central data repository; and retrieving, from the stored installation site data, performance data derived from the installation site data of the multiple product installation sites and providing the performance data to an authorized user of the data.

2. The method of claim 1 wherein the pre-installation data comprises data selected from the types of data consisting of: installer data, contractor data, building data, and product data.

3. The method of claim 1 wherein the post-installation data comprises data related to the indoor air environment selected from the types of data consisting of: building owner data; building manager data; meter data; coupon data; medical data of occupants; and insurance data.

4. The method of claim 1 wherein the product comprises an antimicrobial coating applied to a substrate.

5. The method of claim 1 wherein collecting comprises periodically collecting the installation site data.

6. The method of claim 1 wherein storing comprises storing the installation site data in a computer database and wherein retrieving comprises retrieving the performance data from a computer database.

7. The method of claim 6 wherein storing the installation site data in a computer database comprises remotely storing the installation site data using a web-based user interface.

8. The method of claim 1 wherein retrieving further comprises analyzing the performance data.

9. The method of claim 1 wherein the performance data is related to the performance of the product installation.

10. The method of claim 1 wherein the product installation site is residential or commercial.

11. The method of claim 1 wherein the user comprises a customer of the performance data.

12. The method of claim 1 wherein collecting installation site data comprises collecting multiple installation site data related to multiple indoor air environments at multiple product installation sites.

13. The method of claim 1 wherein retrieving comprises correlating performance data derived from the installation site data of multiple product installation sites.

14. The method of claim 1 wherein the performance data is related to the effectiveness of the product at at least one of the multiple installation sites.

15. The method of claim 1 wherein providing the performance data comprises distributing the data to an authorized user via the Internet.

16. The method of claim 1 providing the performance data comprises distributing the data to an authorized in the form of a report.

17. The method of claim 16 wherein the report is an electronic report.

18. The method of claim 1 wherein the performance data corresponds to quality of the indoor air environment as a result of a product installation.

19. The method of claim 1 wherein the performance data corresponds to energy efficiency as a result of a product installation.

20. The method of claim 1 wherein the multiple product installation sites are independent and remote.

21. The system of claim 1 wherein the multiple product installation sites are independent and remote.

22. A system for processing data related to the performance of an indoor air environment product installation comprising:

a computer system including memory;

a program stored in the memory for:

collecting installation site data related to an indoor air environment at a remote product installation site, wherein the installation site data of a product installation site comprises pre-installation data related to the characteristics of an installed product and information corresponding to the product installation site, and post-installation data related to an effect that the installed product has on the indoor air environment at that site, and storing the installation site data, including the pre-installation and post-installation data of the multiple product installation sites, at a central data repository; and retrieving, from the stored installation site data, performance data derived from the installation site data of the multiple product installation sites, and providing the performance data to an authorized user of the data.

23. The system of claim 22 wherein the pre-installation data comprises data selected from the types of data consisting of: installer data, contractor data, building data, and product data.

24. The system of claim 22 wherein the post-installation data comprises data related to the indoor air environment selected from the types of data consisting of: building owner data; building manager data; meter data; coupon data; medical data of occupants; and insurance data.

25. The system of claim 22 wherein the product comprises an antimicrobial coating applied to a substrate.

26. The system of claim 22 wherein collecting comprises periodically collecting the installation site data.

27. The system of claim 22 wherein storing comprises storing the installation site data in a computer database and wherein retrieving comprises retrieving the performance data from the computer database.

28. The system of claim 27 wherein storing the installation site data in a computer database comprises remotely storing the installation site data using a web-based user interface.

29. The system of claim 22 wherein retrieving further comprises analyzing the performance data.

30. The system of claim 22 wherein the performance data is related to the performance of the product installation.

31. The system of claim 22 wherein the product installation site is residential or commercial.

32. The system of claim 22 wherein the user comprises a customer of the performance data.

33. The system of claim 22 wherein collecting installation site data comprises collecting multiple installation site data related to multiple indoor air environments at multiple product installation sites.

34. The system of claim 22 wherein retrieving comprises correlating performance data derived from the installation site data of multiple product installation sites.

35. The system of claim 22 wherein the performance data is related to the effectiveness of the product at at least one of the installation sites.

36. The system of claim 22 wherein providing the performance data comprises distributing the data to an authorized user via the Internet.

37. The system of claim 22 providing the performance data comprises distributing the data to an authorized in the form of a report.

38. The system of claim 37 wherein the report is an electronic report.

39. The system of claim 22 wherein the performance data corresponds to quality of the indoor air environment as a result of a product installation.

40. The system of claim 22 wherein the performance data corresponds to energy efficiency as a result of a product installation.

* * * * *

UNITED STATES PATENT AND TRADEMARK OFFICE

CERTIFICATE OF CORRECTION

PATENT NO. : 6,925,422 B1
APPLICATION NO. : 10/190302
DATED : August 2, 2005
INVENTOR(S) : John S. Desmond It is certified that error appears in the above-identified patent and that said Letters Patent is hereby corrected as shown below:

At column 9, lines 56-57, delete claim 21.

At column 10, line 65, add -- 41. The system of claim 22 wherein the multiple product installation sites are independent and remote--.

Signed and Sealed this

Twenty-sixth Day of December, 2006

JON W. DUDAS
*Director of the United States Patent and Trademark Office*